US008256691B2

(12) United States Patent
Bolz et al.

(10) Patent No.: US 8,256,691 B2
(45) Date of Patent: Sep. 4, 2012

(54) NOZZLE MODULE FOR AN INJECTION VALVE AND INJECTION VALVE

(75) Inventors: Stephan Bolz, Pfatter (DE); Carsten Götte, Groβberg (DE); Martin Götzenberger, Ingolstadt (DE)

(73) Assignee: Continental Automotive GmbH, Hannover (DE)

( * ) Notice: Subject to any disclaimer, the term of this patent is extended or adjusted under 35 U.S.C. 154(b) by 533 days.

(21) Appl. No.: 12/519,171

(22) PCT Filed: Nov. 26, 2007

(86) PCT No.: PCT/EP2007/062793

§ 371 (c)(1),
(2), (4) Date: Jun. 22, 2008

(87) PCT Pub. No.: WO2008/071535

PCT Pub. Date: Jun. 19, 2008

(65) Prior Publication Data

US 2010/0034921 A1 Feb. 11, 2010

(30) Foreign Application Priority Data

Dec. 13, 2006 (DE) ..... 10 2006 058 881

(51) Int. Cl.
*B05B 1/24* (2006.01)

(52) U.S. Cl. ..... 239/135; 239/585.1

(58) Field of Classification Search ..... 239/135, 239/128, 130, 132, 139, 88–95, 533.2, 585.1, 239/585.3–585.5

See application file for complete search history.

(56) References Cited

U.S. PATENT DOCUMENTS

| | | | | |
|---|---|---|---|---|
| 3,868,939 | A | 3/1975 | Friese et al. | |
| 4,082,067 | A | 4/1978 | Yanagihara | |
| 5,054,458 | A | 10/1991 | Wechem et al. | |
| 5,159,915 | A | 11/1992 | Saito et al. | |
| 5,201,341 | A | 4/1993 | Saito et al. | |
| 5,758,826 | A | 6/1998 | Nines | |
| 2001/0030186 | A1 * | 10/2001 | Schielke | 219/505 |

(Continued)

FOREIGN PATENT DOCUMENTS

DE 2210250 A1 9/1973

(Continued)

OTHER PUBLICATIONS

German Office Action dated Jul. 13, 2007.

(Continued)

*Primary Examiner* — Davis Hwu
(74) *Attorney, Agent, or Firm* — Laurence A. Greenberg; Werner H. Stemer; Ralph E. Locher

(57) ABSTRACT

A nozzle module for an injection valve has a nozzle body with a nozzle body opening extending in the direction of a longitudinal axis, and which can be hydraulically coupled to a fluid feed; a nozzle needle which is movable axially in the nozzle body opening and which in a closed position prevents a flow of fluid through at least one injection opening and otherwise releases the fluid flow; and an induction-heated heating element disposed between the nozzle body and the nozzle needle. The heating element is at least partially spaced a distance away from the nozzle body and from the nozzle needle, and during operation of the injection valve the fluid can flow against a side of the heating element facing the nozzle body and a side of the heating element facing the nozzle needle.

12 Claims, 2 Drawing Sheets

U.S. PATENT DOCUMENTS

| | | | |
|---|---|---|---|
| 2001/0040187 | A1 | 11/2001 | Ren et al. |
| 2005/0258266 | A1 | 11/2005 | Elia et al. |

FOREIGN PATENT DOCUMENTS

| | | | |
|---|---|---|---|
| DE | 19835864 | A1 | 2/2000 |
| DE | 10045753 | A1 | 3/2002 |
| WO | 9905411 | A1 | 2/1999 |
| WO | 2005042964 | A1 | 5/2005 |
| WO | 2007109715 | A1 | 9/2007 |

OTHER PUBLICATIONS

International Search Report dated Mar. 14, 2008.

* cited by examiner

NOZZLE MODULE FOR AN INJECTION VALVE AND INJECTION VALVE

BACKGROUND OF THE INVENTION

Field of the Invention

Ever more stringent statutory requirements relating to the permissible emission of harmful substances from internal combustion engines employed in motor vehicles make it necessary to adopt various measures by means of which the harmful emissions can be reduced. One approach here is to cut the harmful emissions generated by the internal combustion engine. The formation of soot depends greatly on the preparation of the air/fuel mixture in the particular cylinder of the internal combustion engine.

US 2001/0040187 A1 discloses a method for heating fuel, in which an injector is provided with an internal heating device and an associated valve needle. Fuel for the injector is provided, fuel is directed and heated by means of at least one flow distribution element.

U.S. Pat. No. 5,758,826 discloses an internal heating device for a fuel injector, with a field with plates made of a material with a positive temperature coefficient (PTC), which is arranged in the form of a square pipe around a valve element and is surrounded by a heat-insulated sleeve.

DE 100 45 753 A1 discloses a method for operating a self-igniting internal combustion engine, where at least one combustion chamber of the internal combustion engine is fed with fuel from at least one injection valve. Before injection, the fuel is heated in the at least one combustion chamber.

DE 198 35 864 A1 discloses a device for heating fluid substances. This comprises a container or a corresponding pipe provided for accommodation or direction of the substance to be heated and a heatable heat transfer element, which is arranged in the container or as the case may be pipe, and preferably comprises steel wool, metal chips or expanded metal.

DE 22 10 250 discloses a fuel injection device, in particular for externally ignited internal combustion engines with heating of the fuel by means of an electrical heating element taking place directly ahead of the injection location, controllable through the engine temperatures influencing the mixture formation.

BRIEF SUMMARY OF THE INVENTION

The object of the invention is to create a nozzle module and an injection valve which enable reliable and precise operation.

The object is achieved by the features of the independent claims. Advantageous embodiments of the invention are indicated in the subclaims.

According to a first aspect, the invention is characterized by a nozzle module for an injection valve, with a nozzle body, which has a nozzle body recess extending in the direction of a longitudinal axis, which can be coupled hydraulically with a fluid feed, a nozzle needle arranged in an axially movable manner in the nozzle body recess, which in a closed position prevents a fluid flow through at least one injection opening and otherwise releases the fluid flow, and a heating element which can be heated by induction, and which is arranged between the nozzle body and the nozzle needle, where the heating element is at least partially embodied spaced at a distance from the nozzle body and the nozzle needle, and where during operation of the injection valve fluid can flow against a side of the heating element facing the nozzle body and a side of the heating element facing the nozzle needle, and the heating element is embodied as a path folded in zigzag form between the nozzle body and the nozzle needle, which takes the form of a hollow cylinder extending in an axial direction.

This has the advantage that an extensive heat transfer area between heating element and fluid is enabled at the same time as a minimal average distance between heating element and fluid. Good heat transfer between the heating element and the fluid is thus achieved. A large heat transfer area between heating element and fluid is realized by means of the embodiment of the heating element as a path folded in zigzag form.

In an advantageous embodiment of the invention, the heating element has a porous material. A very large area of the heating element relative to the fluid and thus a very large heat transfer area between heating element and fluid can thus be embodied.

In a further advantageous embodiment of the invention, the heating element abuts the nozzle body, and is fixed relative to the nozzle body at least in a radial direction to the longitudinal axis. Simple fixing of the heating element in a radial direction can thus be realized.

In a further particularly advantageous embodiment of the invention, the heating element is embodied as a sintered body, with voids, which are arranged and embodied such that the heating element can be flowed through by the fluid in an axial direction. This has the advantage that a very large heat transfer area between the heating element and the fluid is possible. It is thus possible to realize small external dimensions of the heating element.

In a further advantageous embodiment of the invention, the heating element is of a material which has a Curie temperature between 100° C. and 200° C. An inherently safe embodiment of the heating element is thus possible through limitation of the temperature of the heating element and thus of the fluid flowing through this. External regulation of the heating element can thus be dispensed with.

In a further particularly advantageous embodiment of the invention, the heating element is of a material with a Curie temperature of around 120° C. The Curie temperature of the heating element is thus in the area of a typical evaporation temperature of a fluid embodied as the fuel, with at the same time more inherently safe embodiment of the heating element. If the fluid is in particular ethanol, which at a pressure of 5 to 6 bar has an evaporation temperature of 120° C., this can safely evaporate.

In a further advantageous embodiment of the invention, the heating element is made of titanium oxide. Titanium oxide has a Curie temperature of 120° C. It is therefore possible to limit the temperature of the heating element and thus the temperature of the fluid flowing through it to a temperature of 120° C.

According to a second aspect, the invention is characterized by a nozzle module for an injection valve, with a nozzle body, which has a nozzle body recess extending in the direction of a longitudinal axis, which can be coupled hydraulically with a fluid feed, a nozzle needle arranged in an axially movable manner in the nozzle body recess, which in a closed position prevents a fluid flow through at least one injection opening and otherwise releases the fluid flow, and a heating element which can be heated inductively, and which is arranged between the nozzle body and the nozzle needle, where the heating element is of a porous material, and during operation of the injection valve can be flowed through by the fluid in an axial direction.

The advantageous embodiments of the second aspect of the invention correspond to those of the first aspect of the invention.

The advantage of a nozzle module of this kind consists in that a very large heat transfer area between the heating element and fluid is possible. Small external dimensions of the heating element can thus be realized.

According to a third aspect, the invention is characterized by an injection valve with an actuator and a nozzle module, where the actuator and the nozzle module are connected with each other.

Exemplary embodiments of the invention are explained in greater detail as follows on the basis of the schematic drawings, wherein:

BRIEF DESCRIPTION OF THE SEVERAL VIEWS OF THE DRAWING

Elements of the same construction or function are identified with the same reference numbers across all the figures.

DESCRIPTION OF THE INVENTION

Figure 1:
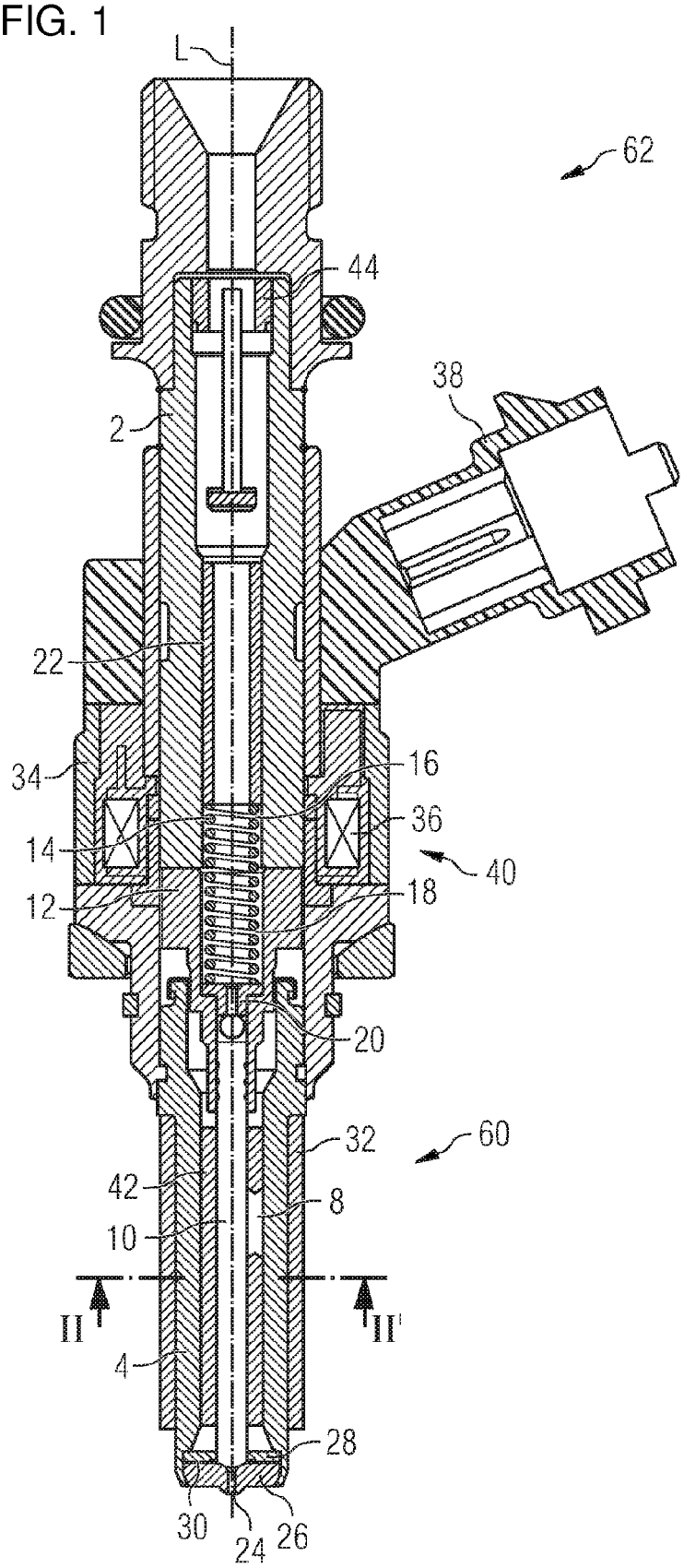
FIG. 1 shows a longitudinal section through an injection valve with a nozzle module.

An injection valve 62 (FIG. 1), which is provided in particular to inject fuel into an internal combustion engine, comprises a fluid inlet pipe 2, an actuator 40 and a nozzle module 60.

The nozzle module 60 has a nozzle body 4 with a longitudinal axis L and a nozzle body recess 8. The nozzle body 4 can be embodied in one piece or in a number of parts. A one-piece or multipart nozzle needle 10 is arranged in the nozzle body recess 8. A heating element 42 is further arranged in the nozzle body recess 8 between the nozzle body 4 and the nozzle needle 10, which can be heated magnetically and inductively. Part of an injector body 12 is additionally arranged in the nozzle body recess 8.

The injection valve 62 is connected to a pressure circuit of a fluid which is not shown, via the fluid inlet pipe 2. In the fluid inlet pipe 2 is a recess 16, which extends as far as a recess 18 of the injector body 12. A spring 14 is arranged in the recess 16 of the fluid inlet pipe 2 and/or the recess 18 of the injector body 12. The spring 14 is supported on the one hand preferably on a disk 20, which is mechanically connected with the injector body 12. The injector body 12 is in turn permanently mechanically linked with the nozzle needle 10, so that the spring 14 is mechanically linked with the needle 10. A pipe sleeve 22 is arranged in the recess 16 of the fluid inlet pipe 2, forming a further seating for the spring 14.

The pipe sleeve 22 is positioned such that the spring 14 is pretensioned in such a way that the nozzle needle 10 assumes a closed position on a seat body 26 which is assigned to it, and in which it prevents the fluid flow through an injection opening 24. Instead of one injection opening 24, multiple injection openings can also be embodied in the seat body 26. The injection opening 24 is preferably an injection orifice.

The seat body 26 can be embodied as one piece with the nozzle body 4, however the seat body 26 and nozzle body 4 can be embodied as separate parts. The nozzle module 60 furthermore has a distance plate 28 for guidance of the nozzle needle 10 and a swirl disk 30 for distribution of the fluid.

A coil unit 32 is arranged around part of the nozzle body 4, which interacts with the heating element 42 which can be heated inductively, and the function of which is explained further below.

The actuator 40 of the injection valve 62 is preferably an electromagnetic unit with a coil 36 arranged in an actuator housing 34. The actuator housing 34 is preferably formed from plastic. An electric voltage can be applied to the actuator 40 via a connection socket 38. Parts of the nozzle body 4, the injector body 12 and the fluid inlet pipe 2 form an electromagnetic circuit. The actuator 40 can alternatively also be a solid state actuator, in particular a piezoelectric actuator.

Figure 2:
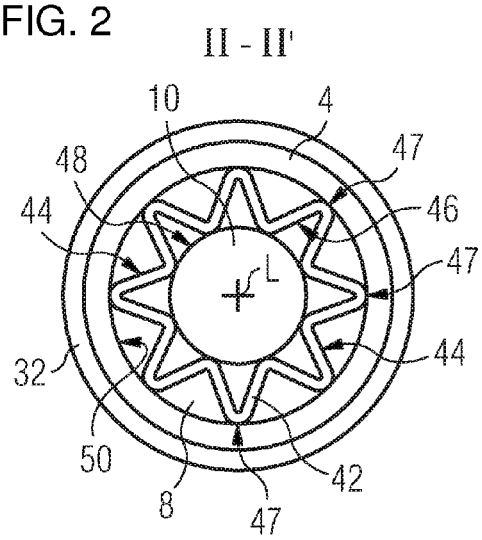
FIG. 2 shows a detailed view of a first embodiment of the nozzle module as a cross-section along the line II-II' of FIG. 1.
Figure 3:
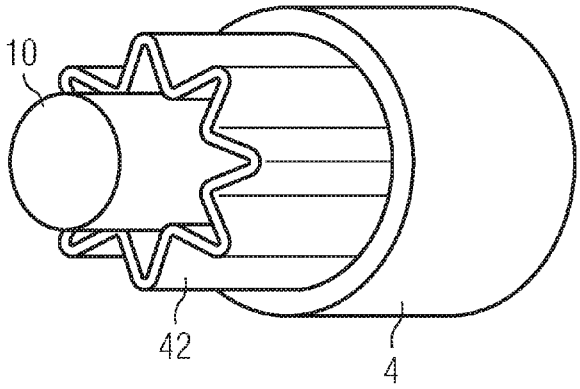
FIG. 3 shows a further detailed view of the first embodiment of the nozzle module as a three-dimensional view.

FIGS. 2 and 3 show, respectively, a cross-section and a three-dimensional view of part of the nozzle module 62. The heating element 42 arranged between the nozzle body 4 and the nozzle needle 10, which can be heated inductively, is embodied as a path, which is folded in zigzag form between the nozzle body 4 and the nozzle needle 10. In this way a hollow cylinder extending in an axial direction is embodied. At least one side 44 of the heating element 42 facing the nozzle body 4 is spaced at a distance from an internal wall 50 of the nozzle body 4. At least one side 46 of the heating element 42 facing the nozzle needle 10 is spaced at a distance from an external wall 48 of the nozzle needle 10. The heating element 42 additionally has wall sections 47, which abut the internal wall 50 of the nozzle body 4. They are preferably arranged such that they are evenly distributed over the circumference of the internal wall of the nozzle body 4. The heating element 42 is thus fixed relative to the nozzle body 4 in a radial direction to the longitudinal axis L in a particularly simple manner.

As a result of the zigzag-form folding of the heating element 42, a large heat transfer area is available between the heating element 42 which can be heated by induction, and the fluid located in the nozzle body recess 8. Furthermore, the average distance between the heating element 42 and the fluid in the nozzle body recess 8 is small. A small thermal resistance and a small thermal time constant can thus be attained. In conjunction with a relatively long dwell time on the fuel at the sides 44, 46 of the heating element 42, a favorable value for the dynamic heat transfer is then achievable.

Figure 4:
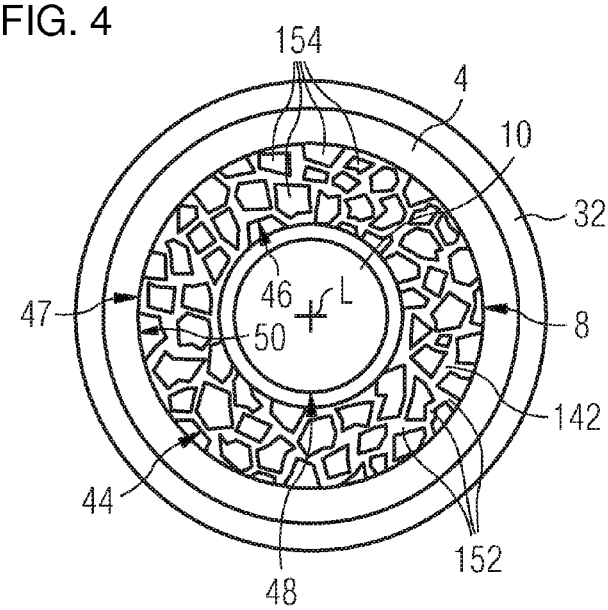
FIG. 4 shows a detailed view of a second embodiment of the nozzle module as a cross-section.

FIG. 4 shows a cross section through the nozzle module 60 analogous to the cross section in FIG. 2. Between the nozzle body 4 and the nozzle needle 10 a heating element 142 is arranged in the nozzle body recess 8, which has a porous material and is preferably embodied as a sintered body. The heating element 142 is preferably spaced at a distance from the nozzle needle 10, in order to be able to guarantee friction-free movement of the nozzle needle 10 in the nozzle body recess 8. The heating element 142, which is embodied as a sintered body has a multiplicity of interconnected studs 152 and voids 154.

The voids 154 are arranged between the studs 152. Some of the voids 154 form the areas of the heating element 142 lying opposite the nozzle body 4 or the nozzle needle 10. The voids 154 are embodied in such a way that the heating element 142 can be flowed through by the fluid in an axial direction. The sides 44 of the voids 154 of the heating element 42 lying opposite the nozzle body 4 are spaced at a distance from the internal wall 50 of the nozzle body 4. Accordingly, the sides 46 of the voids 154 lying opposite the nozzle needle 10 are at a distance from the external wall 48 of the nozzle needle 10.

By means of the multiplicity of studs 152, a very large heat transfer area can be achieved between the heating element 142 and the fluid in the nozzle body recess 8. At the same time, a very small average distance between the fluid and the studs 152 is achieved. A very low thermal resistance and a very small thermal time constant can thereby be attained. Consequently, the relationship between the dwell time of the fluid and the thermal time constant can reach such a high value that the desired fluid temperature in concrete applications is largely independent of the fluid mass flow rate. Alternatively, as a result of the relationship of dwell time to thermal time constant achieved, the heating element 142 can also be embodied to be sufficiently small that it can be used in a restricted structural space and costs thereby saved.

In an alternative embodiment the heating element 142 which can be heated by induction can be embodied in such a way that in the direction of the nozzle needle 10 the heating element 142 has a completely continuous internal wall and/or in the direction of the nozzle body 12 has a completely continuous external wall. The expression completely continuous here means that the internal wall or external wall respectively are not penetrated by voids 154.

The method of functioning of the injection valve is represented below:

In the closed position, the nozzle needle 10 is pressed against the injection opening 24 by means of the spring 14, and a flow of fluid through the injection opening 24 prevented.

In an open position, the nozzle needle 10 is spaced at a distance from the seat body 26, and fluid can travel from the recess 16 of the fluid inlet pipe 2 via the recess 18 of the injector body 12 and the nozzle body recess 8 to the injection opening 24, by means of which a flow of fluid through the injection opening 24 is enabled.

If the temperature of the fluid is not sufficiently high, then by means of a coil unit 32 a magnetic field can be established, which brings about inductive heating in the heating element 42, 142. The heating element 42, 142 is heated until the material of the heating element 42, 142 loses its magnetic properties upon its Curie temperature being exceeded. A further induction in the heating element 42, 142 and consequential further heating to a level above the Curie temperature of the material of which the heating element 42, 142 consists is thereby prevented.

If further fluid flows through or around the heating element 42, 142 which can be heated by induction, and the temperature of the heating element 42, 142 which can be heated by induction consequently again falls below the Curie temperature of the material of which the heating element 42, 142 consists, then by means of the magnetic field of the coil unit 32, an induction can once again set in the heating element 42, 142 and a consequent renewed heating of the heating element 42, 142 can take place. An inherently safe embodiment of the heating elements 42, 142 is thus enabled by means of a limitation of the temperature of the heating element 142, 42 to its Curie temperature and a consequent limitation of the temperature of the fluid flowing through the heating element 42, 142. External regulation of the heating element 42, 142 with an associated temperature sensor and control loop can thereby be dispensed with.

If the heating element 42, 142 has a material with a Curie temperature between 100 and 200° C., then the fluid can be inherently safely heated to a temperature between 100 and 200° C. In the event that the fluid is a fuel for an internal combustion engine, then by means of the suitable choice of material for the heating element 42, 142 a sufficiently high evaporation temperature of the fuel can be achieved, without the fear of excessively powerful heating of the fuel arising.

If the heating element 42, 142 comprises a material with a Curie temperature of approximately 120° C., then ethanol can be employed as the fluid for an internal combustion engine. At a working pressure of 5 to 6 bar, ethanol has an evaporation temperature of 120° C. Through the use of a material with a Curie temperature of approximately 120° C. for the heating element 42, 142, it is thus possible to achieve reliable evaporation of ethanol without compromising safety.

If the heating element 42, 142 comprises titanium oxide, which has a Curie temperature of approximately 120° C., then the temperature of the fluid flowing through the heating element 42, 142 can be limited to 120° C. in a simple manner. The use of titanium oxide on the one hand brings about inherent thermal safety of the heating elements 42, 142 for the fluid, and on the other ensures that reliable evaporation of a fluid such as ethanol can be achieved.

The invention claimed is:

1. A nozzle module for an injection valve, comprising:

a nozzle body formed with a nozzle body opening extending in a direction of a longitudinal axis and configured for hydraulic coupling with a fluid feed;

a nozzle needle disposed to be movable in an axial direction in said nozzle body opening and configured to prevent a fluid flow through at least one injection opening in a closed position and otherwise to release the fluid flow; and an inductively heated heating element having opposed elongated heating surfaces disposed between said nozzle body and said nozzle needle, said heating surfaces of said heating element being at least partially spaced at a spacing distance from said nozzle body and from said nozzle needle, such that, during an operation of the injection valve, fluid flows against a surface of said heating element facing said nozzle body and against a surface of said heating element facing said nozzle needle, and said opposed elongated surfaces of said heating element being a zigzag configuration having said opposed elongated surfaces extending in the axial direction defining a folded path between said nozzle body and said nozzle needle in the shape of a hollow cylinder extending in the axial direction.

2. The nozzle module according to claim 1, wherein said heating element is composed of a porous material.

3. The nozzle module according to claim 1, wherein a first of said surfaces of said heating element abuts said nozzle body, and an opposite one of said surfaces is fixed opposite said nozzle body at least in a radial direction relative to the longitudinal axis.

4. The nozzle module according to claim 1, wherein said heating element is composed of a material having a Curie temperature of between 100° C. and 200° C.

5. The nozzle module according to claim 1, wherein said heating element is composed of a material having a Curie temperature of approximately 120° C.

6. The nozzle module according to claim 1, wherein said heating element is composed of titanium oxide.

7. An injection valve, comprising a nozzle module according to claim 1 and an actuator for driving said nozzle needle.

8. A nozzle module for an injection valve, comprising:

a nozzle body formed with a nozzle body opening extending in a direction of a longitudinal axis and configured for hydraulic coupling with a fluid feed;

a nozzle needle disposed to be movable in an axial direction in said nozzle body opening and configured to prevent a fluid flow through at least one injection opening in a dosed position and otherwise to release the fluid flow; and an inductively heated heating element disposed between said nozzle body and said nozzle needle, said heating element containing a porous material comprising a plurality of interconnected studs and a plurality of voids defined by sides being arranged between said studs, some of said sides of said voids disposed closer to said nozzle body than said nozzle needle and others of said sides of said voids disposed closer to said nozzle needle than said nozzle body, and said studs and said sides of said voids configured, during an operation of the injection valve, to enable fluid flow in the axial direction and friction free movement of the said nozzle needle.

9. The nozzle module according to claim 8, wherein said heating element is composed of a material having a Curie temperature of between 100° C. and 200° C.

10. The nozzle module according to claim 8, wherein said heating element is composed of a material having a Curie temperature of approximately 120° C.

11. The nozzle module according to claim 8, wherein said heating element is composed of titanium oxide.

12. An injection valve, comprising a nozzle module according to claim 8 and an actuator for driving said nozzle needle.

* * * * *